US007367483B2

(12) United States Patent
Nassanian

(10) Patent No.: US 7,367,483 B2
(45) Date of Patent: May 6, 2008

(54) STRAP ASSEMBLY WITH CUSHIONING ELEMENTS

(75) Inventor: Hrag Nassanian, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 651 days.

(21) Appl. No.: 10/855,886

(22) Filed: May 27, 2004

(65) Prior Publication Data

US 2005/0279798 A1 Dec. 22, 2005

(51) Int. Cl.
*A45F 3/04* (2006.01)
*A45F 3/12* (2006.01)

(52) U.S. Cl. ..... 224/643; 224/264

(58) Field of Classification Search ..... 224/264, 224/643, 662, 904, 907, 674; 2/268; D3/327; 601/128, 132; 450/86; 114/266, 267; 441/46, 441/54; 63/3
See application file for complete search history.

(56) References Cited

U.S. PATENT DOCUMENTS

| | | | | | |
|---|---|---|---|---|---|
| 1,444,157 | A | | 2/1923 | Lee | |
| D112,001 | S | * | 11/1938 | Solomon | D2/633 |
| 2,227,724 | A | * | 1/1941 | Kosa, Sr. | 601/132 |
| 3,171,141 | A | * | 3/1965 | Martin et al. | 114/266 |
| 3,553,752 | A | * | 1/1971 | Roberts et al. | 441/54 |
| 4,384,372 | A | * | 5/1983 | Rector | 2/300 |
| 5,038,984 | A | | 8/1991 | Izzo | |
| 5,294,183 | A | | 3/1994 | Wetter et al. | |
| 5,361,957 | A | | 11/1994 | Weintraub | |
| 5,388,274 | A | * | 2/1995 | Glover et al. | 2/338 |
| 5,435,647 | A | | 7/1995 | Oliver | |
| 5,531,665 | A | * | 7/1996 | Chen | 601/118 |
| 5,566,871 | A | | 10/1996 | Weintraub | |
| 5,593,077 | A | | 1/1997 | Izzo | |
| 5,618,262 | A | * | 4/1997 | Rene | 601/116 |
| 5,632,429 | A | * | 5/1997 | Cantwell | 224/630 |
| D415,785 | S | * | 10/1999 | Gettings | D17/20 |
| 6,109,495 | A | | 8/2000 | Hernandez | |
| 6,152,343 | A | | 11/2000 | Shin | |
| 6,168,060 | B1 | | 1/2001 | Mayers | |
| 6,220,492 | B1 | * | 4/2001 | Huang | 224/264 |
| 6,223,959 | B1 | | 5/2001 | Chen | |
| D448,170 | S | | 9/2001 | Ammerman et al. | |
| 6,390,348 | B1 | * | 5/2002 | Godshaw et al. | 224/674 |
| 6,467,661 | B1 | * | 10/2002 | Mistretta et al. | 224/264 |
| 6,471,105 | B1 | | 10/2002 | Ammerman et al. | |
| 6,640,344 | B2 | * | 11/2003 | D'Addario et al. | 2/268 |
| 2002/0108979 | A1 | * | 8/2002 | Finkelstein | 224/264 |

FOREIGN PATENT DOCUMENTS

| | | |
|---|---|---|
| EP | 0 898 906 A2 | 3/1999 |
| FR | 2 406 402 | 10/1978 |
| GB | 2 328 604 A | 3/1999 |
| WO | WO 98/17144 | 4/1998 |
| WO | WO 01/50909 A1 | 7/2001 |

* cited by examiner

*Primary Examiner*—Nathan J. Newhouse
*Assistant Examiner*—Justin M Larson
(74) *Attorney, Agent, or Firm*—Banner & Witcoff, Ltd.

(57) ABSTRACT

A strap assembly for a device for carrying a load includes a plurality of compressible elements. Each compressible element has an aperture extending therethrough. A first strap extends through the aperture of each compressible element. A second strap extends along an exterior of each of the compressible elements. The second strap is connected to the first strap at a plurality of connection points.

29 Claims, 4 Drawing Sheets

STRAP ASSEMBLY WITH CUSHIONING ELEMENTS

FIELD OF THE INVENTION

This invention relates generally to a strap assembly for a device for carrying a load, and, in particular, to a strap assembly for a device for carrying a load that incorporates improved cushioning and air circulation.

BACKGROUND OF THE INVENTION

Straps for devices such as briefcases, backpacks and messenger bags are well known. Due to the weight of the loads carried by such devices it is desirable to provide some cushioning or padding to provide comfort to the user.

Bags are often provided with one or more straps to assist individuals carrying the bag. For example, backpacks typically have a pair of shoulder straps to allow an individual to carry the backpack. Golf bags are typically provided with one, and sometimes two, straps that allow the bag to be carried over the shoulder or shoulders of an individual. Messenger bags, such as those used by bicycle messengers, are typically provided with a single strap, with the strap strung around the neck of the user and resting on their shoulder. Backpacks, golf bags, and other bags, when fully loaded, can be quite heavy. Consequently, providing comfortable straps is considered highly desirable. Such straps typically consist of a length of webbing that connects at either end to the bag, and include padding or a cushion along a central section of the strap. The cushion may consist of a soft fiber, or may include an air-filled bladder. The entire exterior surface of the cushion is typically in contact with a portion of the user's body, such as their shoulder. Such a cushion provides no air circulation between the strap and the user's body.

It is an object of the present invention to provide a strap assembly for a device for carrying a load that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a strap assembly for a device for carrying a load that provides improved cushioning and air circulation.

In accordance with a first aspect, a strap assembly for a device for carrying a load includes a plurality of compressible elements. Each compressible element has an aperture extending therethrough. A first strap extends through the aperture of each compressible element. A second strap extends along an exterior of each of the compressible elements. The second strap is connected to the first strap at a plurality of connection points.

In accordance with another aspect, a strap assembly for a device for carrying a load includes a plurality of compressible elements, with each compressible element having an aperture extending therethrough. A first strap extends through the aperture of each compressible element such that the compressible elements are positioned along the first strap. A second strap extends along a portion of an exterior of each of the compressible elements. Each of a plurality of bands of resilient material slidably connects the second strap to the first strap at a connection point. A connection point is positioned between each of adjacent compressible elements and beyond endmost compressible elements of the plurality of compressible elements positioned along the first strap.

In accordance with a further aspect, a strap assembly for a device for carrying a load includes a plurality of compressible elements, with each compressible element having a first aperture and a second aperture extending therethrough. A first strap extends through the first aperture of each compressible element; and a second strap extends through the first aperture of each compressible element.

Substantial advantage is achieved by providing a strap assembly for a device for carrying a load in accordance with preferred embodiments of the present invention. In particular, such a strap assembly dampens the shock felt by the user, and decreases the surface contact of the strap assembly with the user, thereby increasing air circulation to that area of the user's body. These advantages help to reduce fatigue and discomfort for an individual carrying such a device.

These and additional features and advantages of the invention disclosed here will be further understood from the following detailed disclosure of certain preferred embodiments.

Figure 1:
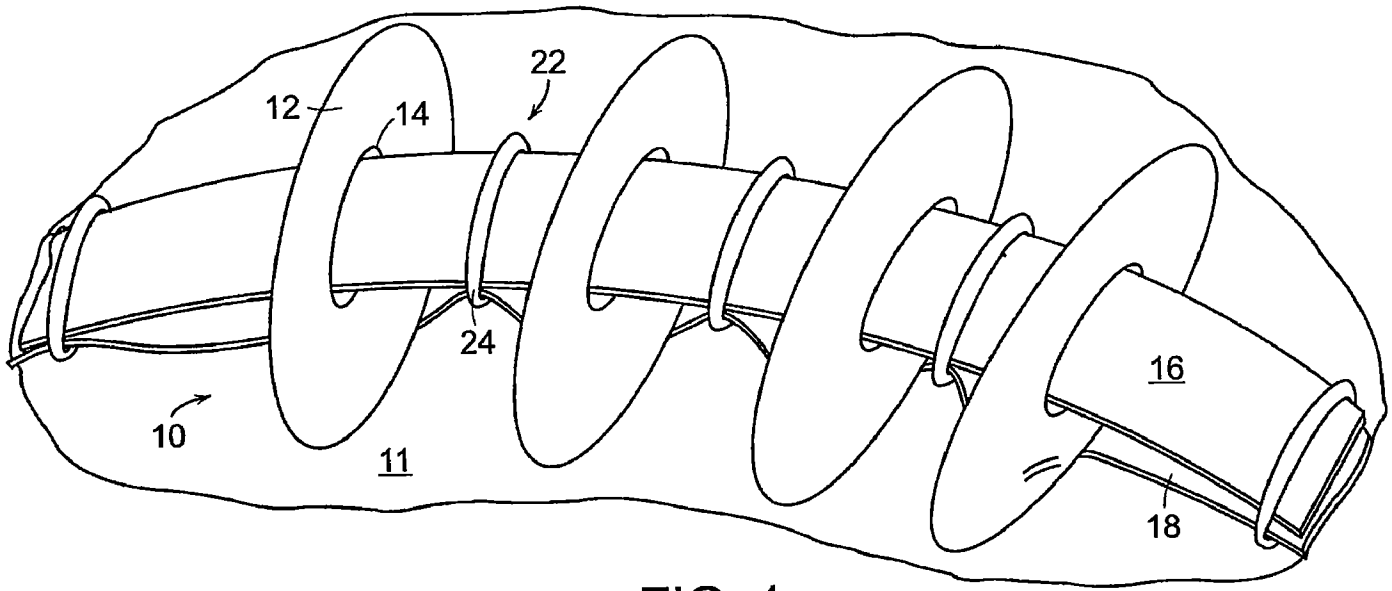
FIG. 1 is a perspective view of a preferred embodiment of a strap assembly in accordance with the present invention.

The figures referred to above are not drawn necessarily to scale and should be understood to provide a representation of the invention, illustrative of the principles involved. Some features of the strap assembly for a device for carrying a load depicted in the drawings have been enlarged or distorted relative to others to facilitate explanation and understanding. The same reference numbers are used in the drawings for similar or identical components and features shown in various alternative embodiments. Straps for a device for carrying a load as disclosed herein would have configurations and components determined, in part, by the intended application and environment in which they are used.

DETAILED DESCRIPTION OF CERTAIN PREFERRED EMBODIMENTS

Figure 2:
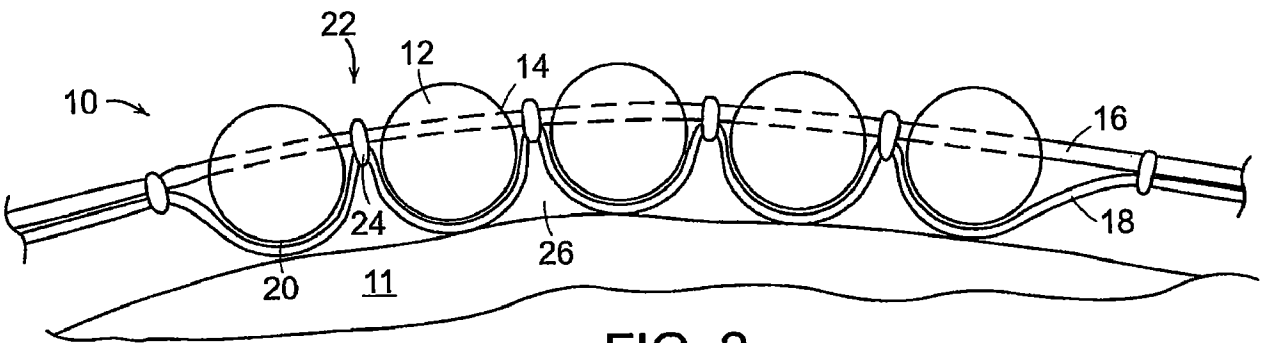
FIG. 2 is a side elevation view of the strap assembly of FIG. 1 shown extended over a shoulder of a user.

The present invention may be embodied in various forms. A preferred embodiment of a strap assembly 10 is shown in FIGS. 1-2. A strap assembly 10 in accordance with certain preferred embodiments of the present invention can be used in conjunction with many devices for carrying a load. For example, a strap assembly 10 can be used with a backpack, a messenger bag, or a golf bag. Other suitable devices with which a strap assembly 10 can be used will become readily apparent to those skilled in the art, given the benefit of this disclosure.

Unless otherwise stated, or otherwise clear from the context below, directional terms used herein, such as rearwardly, forwardly, inwardly, downwardly, upwardly, etc., refer to directions relative to strap assembly 10 in relation to a user. Strap assembly 10 is shown in FIGS. 1-2 to be disposed substantially horizontally over shoulder 11 of a user. However, it is to be appreciated that strap assembly 10 need not be limited to such an orientation and that other orientations of strap assembly 10 are considered to be within the scope of the invention Thus, in the illustrated embodiment of FIGS. 1-2, inwardly and interior refer to directions and surfaces extending toward or exposed to the shoulder of a user, that is, toward the bottom of the page as seen in FIGS. 1 and 2. Accordingly, outwardly and exterior refer to directions and surfaces extending away from or exposed in a direction extending away from the shoulder of a user, that is, toward the top of the page as seen in FIGS. 1 and 2.

Strap assembly 10 includes a plurality of compressible elements 12. Each compressible element 12 has an aperture 14 extending therethrough. In the illustrated embodiment, each compressible element 12 has a substantially cylindrical shape with hemispherical ends. It is to be appreciated that compressible elements 12 can have any desired shape. For example, compressible elements 12 in other preferred embodiments could be a simple cylindrical or cubical shape, or an element that is a combination of these, or other, shapes, or a plurality of shaped elements molded or otherwise constructed together to form a single element such that a plurality of compressible elements is combined into one element. Other suitable shapes for compressible elements 12 will become readily apparent to those skilled in the art, given the benefit of this disclosure.

A first strap 16 extends through each aperture 14. A second strap 18 extends along an interior side of strap assembly 10, along an exterior surface 20 of each compressible element 12. In a preferred embodiment, first and second straps 16, 18 are lengths of webbing, and apertures 14 have the form of slots suitable for receiving webbing. It is to be appreciated that straps 16, 18 and apertures 14 may take any desired shape. Straps 16, 18 may be formed of, for example, nylon webbing, polypropylene webbing, polyurethane webbing or material, PVC material, leather (synthetic or natural) or any other suitable material.

Second strap 18 is connected to first strap 16 at a plurality of connection points 22. In a preferred embodiment, each connection point 22 includes a band 24 formed of resilient material through which first strap 16 and second strap 18 pass. In certain preferred embodiments, each band 24 comprises an elastic band. Band 24 may be formed of any elastomeric cord or strap as well as any non-elastomeric cord or strap, for example, a nylon cord. These bands of resilient material may be surround and contact only the straps, as illustrated here, or they may be sewn into a nearby seam for ease of construction. Other suitable materials for band 24 that will serve to secure second strap 18 to first strap 16 will become readily apparent to those skilled in the art given the benefit of this disclosure.

By connecting second strap 18 to first strap 16 with a band 24 of resilient material, first and second straps 16, 18 are free to move with respect to one another, enhancing the flexibility of strap assembly 10 and comfort and fit for the user.

In the illustrated embodiment, second strap 18 is connected to first strap 16 by a band 24 between each of adjacent compressible elements 12. Additionally, second strap 18 is connected to first strap 16 by a band 24 at a location beyond each endmost compressible element 12 of the plurality of compressible elements 12 positioned along first strap 16.

As can best be seen in FIG. 2, an air gap 26 is created between the user's shoulder 11 and each band 24 due to second strap 18 wrapping around each compressible element 12 between connection points 22, where is it is secured to first strap 16 by a band 24. Air gaps 26 serve to provide ventilation between strap assembly 10 and the user's shoulder 11, thereby increasing comfort for the user.

When a load is applied to strap assembly 10, the portion of each compressible element 12 positioned between first strap 16 and second strap 18 compresses, cushioning the load on the user's shoulder 11 and providing a dampening effect as the load moves. Thus, compressible elements 12 serve to increase the comfort of the user for this additional reason. The compression of each compressible element 12 will vary based on, among other things, the material of which the compressible element is formed, as well as the distance from first aperture 14 to the interior surface of compressible element 12. This distance can be adjusted to vary the amount of desired compression.

Compressible elements 12 may be formed of a compressible foam, such as urethane, EPE foam, or a combination of foams and materials. The foams or other materials of compressible elements 12 may be molded, extruded, or produced in sheet format that is later rolled and sewn into a material sleeve so as to hold its shape. In other preferred embodiments, compressible elements 12 could be fluid-filled bladders filled with air or any other suitable gas or liquid. Other suitable materials for compressible elements 12 will become readily apparent to those skilled in the art, given the benefit of this disclosure. It is to be appreciated that compressible elements 12 may be formed of foams of different densities co-molded together or of foams of different densities and rates of compressibility.

Figure 3:
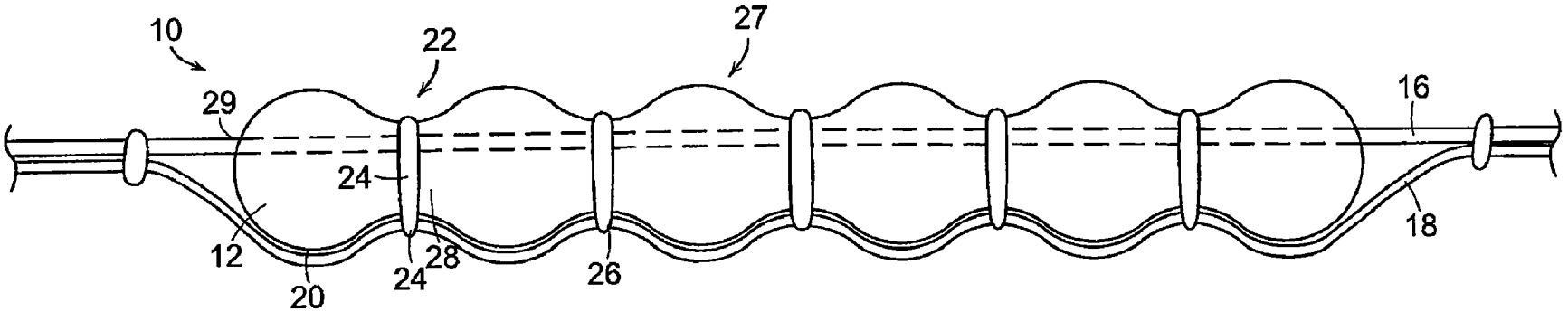
FIG. 3 is a side elevation view of an alternate embodiment of a strap assembly in accordance with the present invention.

Another preferred embodiment is shown in FIG. 3, in which compressible elements 12 are formed of unitary construction, and are joined together to form a compressible member 27. In this embodiment, compressible elements 12 are connected to one another by reduced thickness, or necked portions 28. An aperture 29 extends through compressible elements 12 and necked portions 28 throughout the length of compressible member 27. A band 24 encircles each necked portion 28, through which first strap 16 travels, and second strap 18, thereby securing second strap 18 to first strap 16 by way of necked portion 28.

It is to be appreciated that the number of compressible elements 12 in strap assembly 10 may vary. FIG. 1 illustrates an embodiment with four compressible elements 12; FIG. 2 illustrates an embodiment with five compressible elements 12; while FIG. 3 illustrates an embodiment with six compressible elements. The number of compressible elements 12 in a given strap assembly 10 will vary based on a number of factors, including the size of compressible elements 12, the size and shape of first strap 16 and second strap 18, the type of material that forms compressible elements 12, the size of the device to which strap assembly 10 is secured, and the portion of the user's body that will engage strap assembly 10. Those skilled in the art will be able to determine the requisite number of compressible elements 12 for a particular application, given the benefit of this disclosure.

Figure 4:
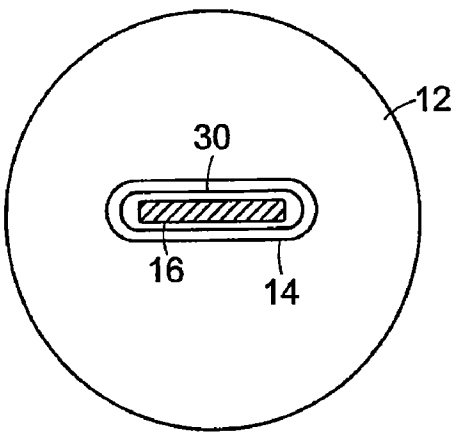
FIG. 4 is an end elevation view of an alternative embodiment of a compressible element of the strap assembly of FIG. 1.

Another preferred embodiment is shown in FIG. 4, in which an insert 30 is positioned in aperture 14. Consequently, first strap 16 passes through insert 30. Insert 30 serves to facilitate movement of first strap 16 back and forth through aperture 14 despite the compression of compressible element 12. Insert 30 may be formed of plastic, metal, composites, or foam material similar to that of compressible element 12 but with a different surface treatment, e.g., a sealed, smooth, or sanded surface, or a different density. Other suitable materials for insert 14 will become readily apparent to those skilled in the art, given the benefit of this disclosure.

Figure 5:
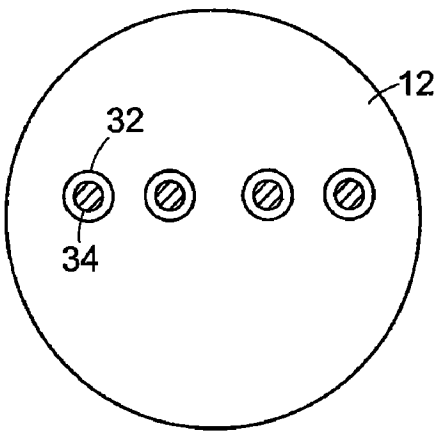
FIG. 5 is an end elevation view of another alternative embodiment of a compressible element of the strap assembly of FIG. 1.

Another preferred embodiment is shown in FIG. 5, in which a plurality of apertures 32 is provided in compressible element 12. In this embodiment, a plurality of first straps 34 is provided, with each first strap 34 extending through a corresponding aperture 32. In the embodiment illustrated here, apertures 32 are circular, and first straps 34 are cords. It is to be appreciated that apertures 32 and first straps 34 may take any desired shape and size.

Figure 7:
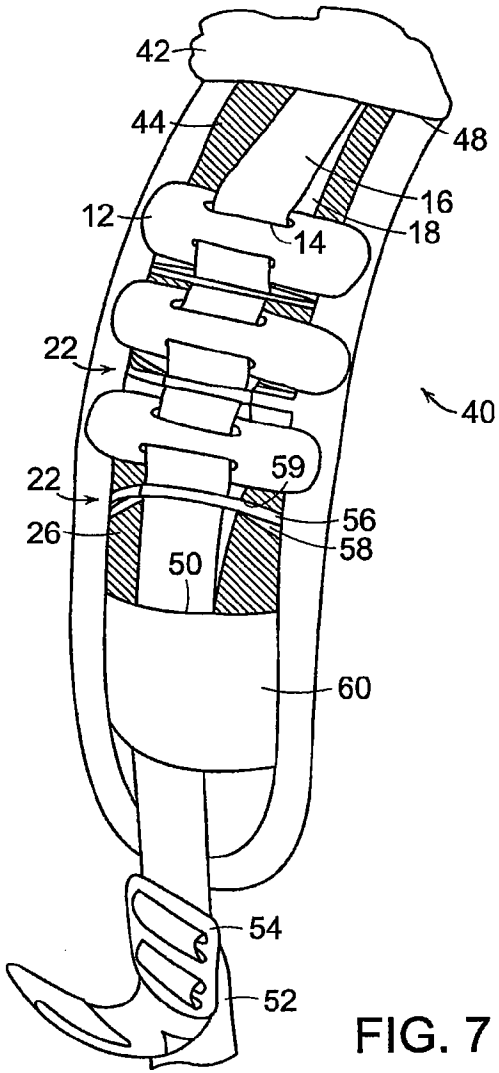
FIG. 7 is a perspective view showing a close up of the strap assembly of FIG. 6.
Figure 6:
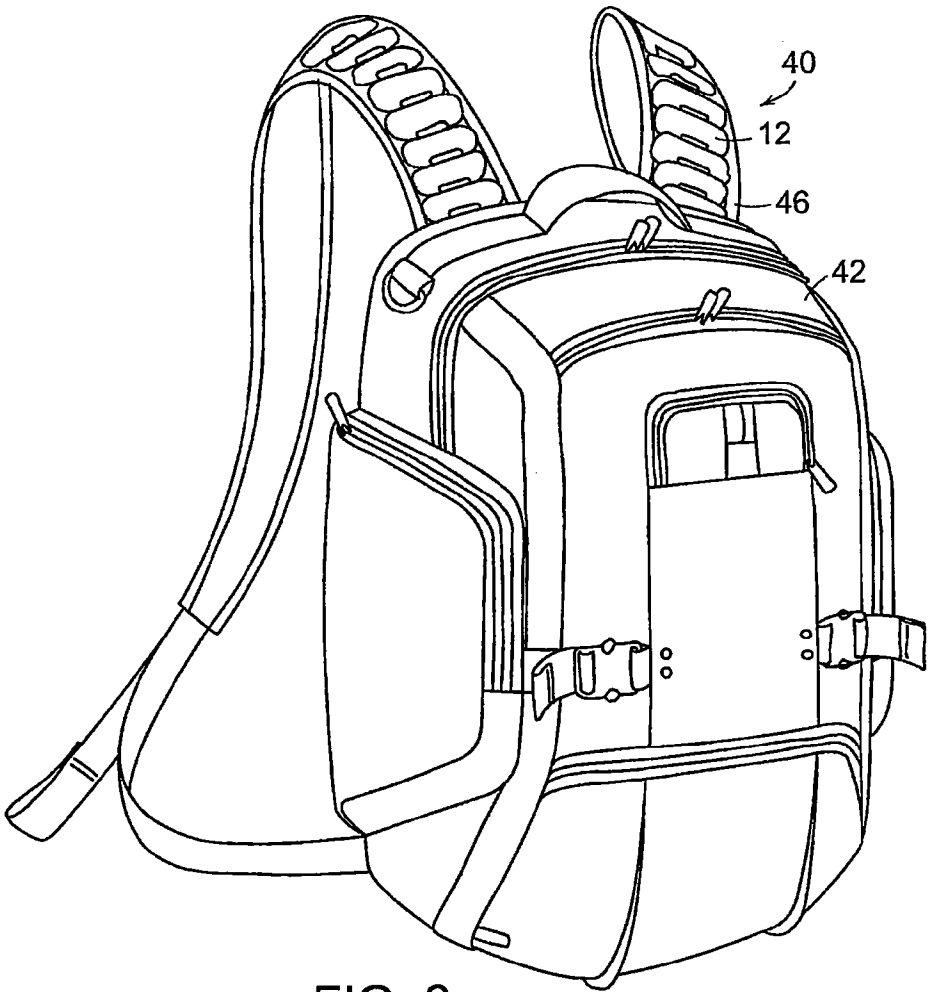
FIG. 6 is a perspective view of an alternate embodiment of a strap assembly in accordance with the present invention shown attached to a back pack.

Another preferred embodiment is shown in FIGS. 6-7 in which a strap assembly 40 is shown secured to a backpack 42. As seen in FIG. 7, strap assembly 40 includes a length of mesh material 44 on the interior side of second strap 18. Mesh material 44 serves to allow air to reach air gaps 26.

A binding 46 is secured to the edges of mesh material 44. Binding 46 may be formed of nylon, polypropylene, PU, PVC, or any other material that can be used to bind multiple materials together. Mesh material 44 may be formed of nylon or any other suitable mesh material, and is formed of an elastic material in a preferred embodiment. A first end 48 of strap assembly 40 is secured to backpack 42, such as by stitching (not shown). A second end 50 of strap assembly 40 is secured to a carrying strap 52. In a preferred embodiment, carrying strap 52 is adjustable, and may include an adjustable fastener 54.

In this embodiment, a pair of strips of material secures first and second strap 16, 18 to each other and to mesh material 44. A first strip of material 56 extends across an outer surface of first strap 16, while a second strip of material 58 extends beneath an inner surface of second strap 18 at each connection point 22. First and second strips of material 56, 58 are secured at opposed ends thereof to binding 46. First and second strips of material 56, 58 are also secured to one another adjacent opposed edges of first and second straps 16, 18, such as by stitching 59, allowing second strap 18 to be raised with respect to mesh material 44 at each connection point 22 in order to provide air gap 26. In other embodiments, second strap 18 could be connected to first strap 16 by a resilient band, as described above in connection with FIGS. 1-2.

In the illustrated embodiment, at second end 50, first and second straps 16, 18 are secured together and to carrying strap 52, such as by stitching (shown here beneath a covering strip of material 60).

Figure 8:
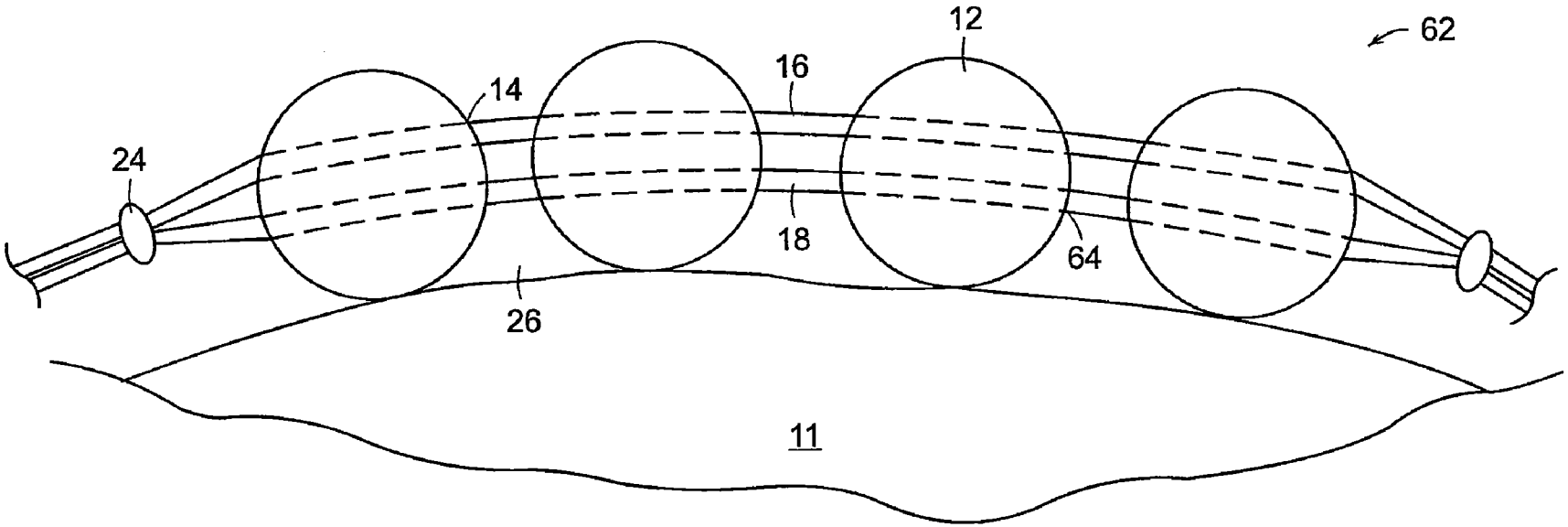
FIG. 8 is a side elevation view of another alternate embodiment of a strap assembly in accordance with the present invention.

Another embodiment of a strap assembly 62 is shown in FIG. 8, in which compressible elements 12 have a second aperture 64 through which second strap 18 extends. In this embodiment, when a load is applied, compression of compressible elements is provided by both first and second straps 16, 18. Second strap 18 is spaced from the user's shoulder to provide air gaps 26 due to the fact that second strap 18 extends through apertures 64. Resilient bands 24 are provided beyond the endmost compressible elements 12 to connect second strap 18 to first strap 16 at those two locations.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A strap assembly for a device for carrying a load comprising, in combination:

a plurality of compressible elements, each compressible element having an aperture extending therethrough;

a first strap extending through the aperture of each compressible element such that the first strap is enclosed on all sides within each compressible element; and a second strap extending along a portion of an exterior of each of the compressible elements and not through any aperture therein, the second strap being connected to the first strap at a plurality of connection points, the second strap wrapping around the compressible elements so as to provide a plurality of gaps between the second strap and the shoulder of a user upon which the strap assembly is carried.

2. The strap assembly of claim 1, wherein the second strap is connected to the first strap between each of adjacent compressible elements.

3. The strap assembly of claim 1, wherein the second strap is connected to the first strap at locations beyond endmost compressible elements of the plurality of compressible elements along the first strap.

4. The strap assembly of claim 1, wherein the plurality of compressible elements are of unitary construction with one another.

5. The strap assembly of claim 1, wherein each compressible element is substantially cylindrical with hemispherical ends.

6. The strap assembly of claim 1, wherein the compressible elements are formed of a compressible foam.

7. The strap assembly of claim 1, wherein the compressible elements are formed of urethane.

8. The strap assembly of claim 1, wherein the apertures are slots.

9. The strap assembly of claim 1, wherein the first strap is a length of webbing.

10. The strap assembly of claim 1, wherein the second strap is a length of webbing.

11. The strap assembly of claim 1, wherein the first and second straps are secured at first ends thereof to a first portion of a bag for carrying a load and at second ends thereof to a first end of a carrying strap, a second end of the carrying strap secured to a second portion of the bag.

12. The strap assembly of claim 11, wherein the carrying strap is adjustable.

13. The strap assembly of claim 1, further comprising a plurality of inserts, each insert positioned in a corresponding aperture to receive a portion of the first strap.

14. The strap assembly of claim 13, wherein the inserts are formed of metal.

15. The strap assembly of claim 13, wherein the inserts are formed of plastic.

16. The strap assembly of claim 1, further comprising a plurality of bands of resilient material, each band positioned at a connection point and encircling the first and second straps.

17. The strap assembly of claim 16, wherein each band of resilient material comprises an elastic band.

18. The strap assembly of claim 1, further comprising a plurality of additional apertures extending through each compressible element, and a plurality of additional first straps, each first strap extending through a corresponding aperture in each compressible element.

19. The strap assembly of claim 18, wherein the apertures are circular and the first straps comprise cords.

20. The strap assembly of claim 1, further comprising:

a length of mesh material;

a binding material secured along edges of the length of mesh material; and a plurality of pairs of strips of material, first and second ends of each strip being secured to the binding material, a first strip of each pair extending over an outer surface of the first strap, a second strip of each pair extending beneath an inner surface of the second strap, the first and second strips secured to one another adjacent opposed edges of the first and second straps.

21. The strap assembly of claim 20, wherein the length of mesh material is formed of an elastic material.

22. A strap assembly for a device for carrying a load comprising, in combination:

a plurality of compressible elements, each compressible element having an aperture extending therethrough;

a first strap extending through the aperture of each compressible element such that the compressible elements are positioned along the first strap and the first strap is enclosed on all sides within each compressible element;

a second strap extending along a portion of an exterior of each of the compressible elements, the second strap wrapping around the exteriors of the compressible elements so as to provide a plurality of gaps between the second strap and the shoulder of a user upon which the strap assembly is carried;

a plurality of bands of resilient material, each band slidably connecting the second strap to the first strap at a connection point, a connection point being positioned between each of adjacent compressible elements and beyond endmost compressible elements of the plurality of compressible elements positioned along the first strap.

23. The strap assembly of claim 22, wherein the compressible elements are of unitary construction with one another.

24. The strap assembly of claim 22, wherein the compressible elements are formed of urethane.

25. The strap assembly of claim 22, further comprising a plurality of inserts, each insert positioned in a corresponding aperture to receive a portion of the first strap.

26. The strap assembly of claim 22, wherein the first strap is a length of webbing.

27. The strap assembly of claim 22, wherein the second strap is a length of webbing.

28. The strap assembly of claim 22, further comprising:

a length of mesh material;

a binding material secured about at least a portion of a circumference of the length of mesh material; and a plurality of pairs of strips of material, first and second ends of each strip being secured to the binding material, a first strip of each pair extending over an outer surface of the first strap, a second strip of each pair extending beneath an inner surface of the second strap, the first and second strips secured to one another adjacent opposed edges of the first and second straps.

29. The strap assembly of claim 28, wherein the length of mesh material is formed of an elastic material.

* * * * *